US010593448B2

(12) United States Patent
Horiuchi et al.

(10) Patent No.: US 10,593,448 B2
(45) Date of Patent: Mar. 17, 2020

(54) PERMANENT MAGNET, AND MOTOR AND POWER GENERATOR USING THE SAME

(71) Applicant: KABUSHIKI KAISHA TOSHIBA, Minato-ku, Tokyo (JP)

(72) Inventors: Yosuke Horiuchi, Tokyo (JP); Shinya Sakurada, Tokyo (JP); Keiko Okamoto, Kanagawa-ken (JP); Masaya Hagiwara, Kanagawa-ken (JP); Tsuyoshi Kobayashi, Kanagawa-ken (JP); Masaki Endo, Tokyo (JP); Tadahiko Kobayashi, Kanagawa-ken (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 546 days.

(21) Appl. No.: 14/068,078

(22) Filed: Oct. 31, 2013

(65) Prior Publication Data

US 2014/0139305 A1 May 22, 2014

(30) Foreign Application Priority Data

Nov. 20, 2012 (JP) ..... 2012-254128

(51) Int. Cl.
*H01F 1/01* (2006.01)
*H01F 1/055* (2006.01)
*C22C 38/00* (2006.01)

(52) U.S. Cl.
CPC ..... *H01F 1/01* (2013.01); *C22C 38/005* (2013.01); *H01F 1/0557* (2013.01)

(58) Field of Classification Search
None
See application file for complete search history.

(56) References Cited

U.S. PATENT DOCUMENTS 4,746,378 A 5/1988 Wysiekierski et al.
2011/0278976 A1* 11/2011 Horiuchi ..... C22C 19/07 310/152

(Continued)

FOREIGN PATENT DOCUMENTS

JP 06-212327 8/1994
JP 09-111383 4/1997

(Continued)

OTHER PUBLICATIONS

Mishra, Thomas, Yoneyama, Fukuno, Ojima. "Microstructure and properties of step aged rare earth alloy magnets." Journal of Applied Physics 52 (1981)2517-2519.*

(Continued)

*Primary Examiner* — Paul A Wartalowicz
*Assistant Examiner* — Stephani Hill
(74) *Attorney, Agent, or Firm* — Amin, Turocy & Watson, LLP

(57) ABSTRACT

In one embodiment, a permanent magnet includes a sintered compact having a composition expressed by a composition formula: Rp1Feq1Mr1Cus1Co100-p1-q1-r1-s1 (R is a rare-earth element, M is at least one element selected from Zr, Ti, and Hf, 10≤p1≤13.3 at %, 25≤q1≤40.0 at %, 0.88≤r1≤5.4 at %, and 3.5≤s1≤13.5 at %). The sintered compact includes crystal grains and a Cu-rich phase. The crystal grains are composed of a main phase including a $Th_2Zn_{17}$ crystal phase. The Cu-rich phase has a composition with a high Cu concentration and an average thickness of 0.05 μm or more and 2 μm or less.

13 Claims, 6 Drawing Sheets

(56) References Cited

U.S. PATENT DOCUMENTS

| | | | | |
|---|---|---|---|---|
| 2012/0074804 | A1 | 3/2012 | Horiuchi et al. | |
| 2012/0146444 | A1 | 6/2012 | Horiuchi et al. | |
| 2012/0242180 | A1 | 9/2012 | Horiuchi et al. | |
| 2013/0241682 | A1* | 9/2013 | Horiuchi | H01F 1/0557 335/302 |

FOREIGN PATENT DOCUMENTS

| | | | | |
|---|---|---|---|---|
| JP | 2002-083728 | | 3/2002 | |
| JP | 2002294413 | A * | 10/2002 | H01F 1/0573 |
| JP | 2009295638 | A * | 12/2009 | H01F 41/02 |
| JP | 2012-204599 | | 10/2012 | |
| JP | 2014-103239 | | 6/2014 | |
| JP | 2014-156656 | | 8/2014 | |
| JP | 2014-220503 | | 11/2014 | |

OTHER PUBLICATIONS

W. Manrakhan, L. Withanawasam, X. Meng-Burany, W. Gong, G. C. Hadjipanayis. "Melt-Spun Sm(CoFeCuZr)zMx (M=B or C) Nanocomposite Magnets." IEEE Transactions on Magnetics, vol. 33, No. 5 Sep. 1997, pp. 3898-3900.*

JP 2002-294413 machine translation (Year: 2002).*

Mukai and Fujimoto. J Appl. Phys. 64 (10) Nov. 15, 1988, p. 5977-5979. (Year: 1988).*

Extended European Search Report for European Patent Application No. 15168643.3 dated Oct. 9, 2015.

European Search Report for Application No. 13192127.2-1556 dated Apr. 3, 2014, 4 pgs.

Maury, et al. "Genesis of the cell microstructure in the Sm(Co, Fe, Cu, Zr) permanent magnets with 2:17 Type", Physica Status Solidi (A), vol. 140, No. 1, Nov. 16, 1993, pp. 57-72, XP055108686.

Liu, et al. "Sm2(Co, Fe, Cu, Zr)17 Magnets with Higher Fe Content", IEEE Transactions on Magnetics, Sep. 1, 1989, pp. 3785-3787, vol. 25, No. 5, IEEE Service Center, New York, NY, US.

Japanese Office Action for Japanese Patent Application No. 2012-254128 dated Jul. 26, 2016.

Japanese Office Action for Japanese Patent Application No. 2012-254128 dated Feb. 21, 2017.

Corfield, et al. Study of solid-state reactions in Sm(Co, Fe, Cu, Zr)z 2.17-type alloys by means of in situ electrical resistivity measurements, Journal of Magnetism and Magnetic Materials 316, 2007, pp. 59-66.

Ishigaki, et al. Effects of Sintering Atmosphere on the Magnetic Properties of Sm(Co, Fe, Cu)7 Permanent Magnet Alloy, Power and Power Metallurgy, Apr. 29, 1982, vol. 30, No. 1, pp. 12-20.

Japanese Office Action for Japanese Patent Application No. 2017-233721 dated Oct. 30, 2018.

* cited by examiner

Cu-RICH PHASE Cu-M-RICH PHASE

Cu-RICH PHASE Cu-M-RICH PHASE

PERMANENT MAGNET, AND MOTOR AND POWER GENERATOR USING THE SAME

CROSS REFERENCE TO RELATED APPLICATION

This application is based upon and claims the benefit of priority from Japanese Patent Application No. 2012-254128, filed on Nov. 20, 2012; the entire contents of which are incorporated herein by reference.

FIELD

Embodiments disclosed herein relate generally to a permanent magnet, and a motor and a power generator using the same.

BACKGROUND

As a high-performance permanent magnet, there have been known rare-earth magnets such as a Sm—Co based magnet and a Nd—Fe—B-based magnet. When a permanent magnet is used for a motor of a hybrid electric vehicle (HEV) or an electric vehicle (EV), the permanent magnet is required to have heat resistance. In a motor for HEV or EV, a permanent magnet whose heat resistance is enhanced by substituting a part of Nd (neodymium) in the Nd—Fe—B based magnet with Dy (dysprosium) is used. Since Dy is one of rare elements, there is a demand for a permanent magnet not using Dy. The Sm—Co based magnet has high Curie temperature, and it is known that the Sm—Co based magnet exhibits excellent heat resistance with a composition system not using Dy. The Sm—Co based magnet is expected to realize a good operating characteristic at high temperatures.

The Sm—Co based magnet is lower in magnetization compared with the Nd—Fe—B based magnet, and cannot realize a sufficient value of the maximum energy product ($(BH)_{max}$). In order to increase the magnetization of the Sm—Co based magnet, it is effective to substitute a part of Co with Fe, and to increase an Fe concentration. However, in a composition range having a high Fe concentration, a coercive force of the Sm—Co based magnet tends to reduce. Further, the Sm—Co based magnet is made of a fragile intermetallic compound, and is generally used as a sintered magnet. Therefore, brittleness of the Sm—Co based magnet is liable to be a problem in view of fatigue characteristics. In the Sm—Co based sintered magnet having a composition with a high Fe concentration, enhancement in mechanical properties such as strength and toughness in addition to improvement in a magnetic property such as a coercive force is required.

DETAILED DESCRIPTION

Figure 1:
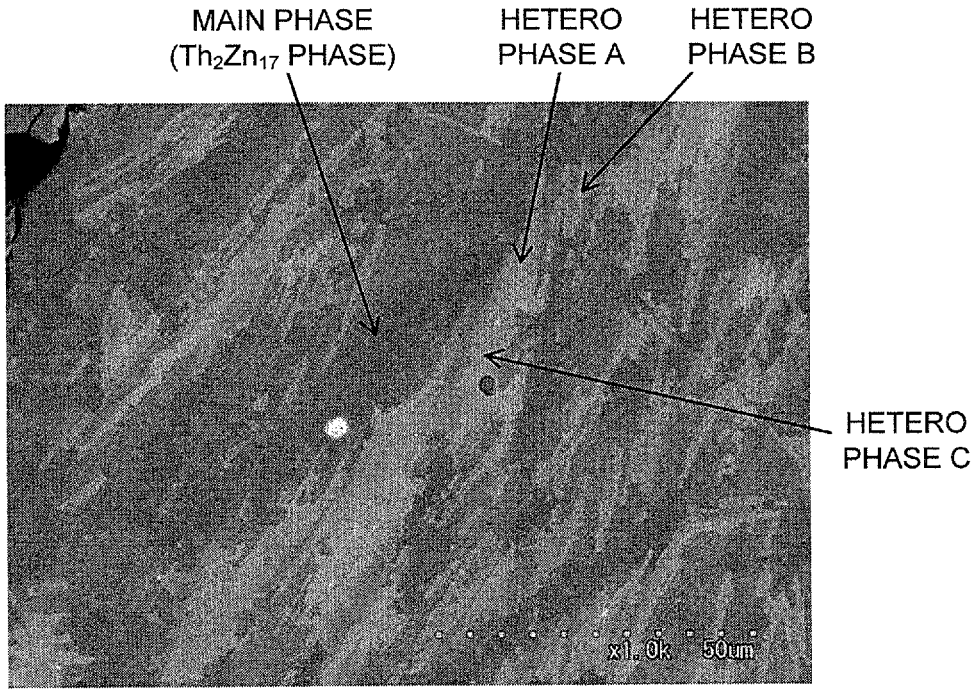
FIG. 1 is a SEM-reflected electron image showing a metallic structure of an alloy ingot used for fabricating a Sm—Co based sintered magnet.

According to one embodiment, there is provided a permanent magnet including a sintered compact which has a composition expressed by a composition formula 1:

$$R_{p1}Fe_{q1}M_{r1}Cu_{s1}Co_{100-p1-q1-r1-s1},$$

wherein R is at least one element selected from the group consisting of rare-earth elements, M is at least one element selected from the group consisting of Zr, Ti, and Hf, p1 satisfies $10 \le p1 \le 13.3$ at %, q1 satisfies $25 \le q1 \le 40$ at %, r1 satisfies $0.87 \le r1 \le 5.4$ at %, and s1 satisfies $3.5 \le s1 \le 13.5$ at %. The sintered compact includes crystal grains and a Cu-rich phase. Each of the crystal grains is composed of a main phase having a $Th_2Zn_{17}$ crystal phase. The Cu-rich phase has a composition whose a Cu concentration is higher than that of the main phase. An average thickness of the Cu-rich phase is from 0.05 μm to 2 μm.

In the composition formula 1, as the element R, at least one element selected from the rare-earth elements containing yttrium (Y) is used. Any of the elements R brings about great magnetic anisotropy and imparts a high coercive force to the permanent magnet. As the element R, at least one selected from samarium (Sm), cerium (Ce), neodymium (Nd), and praseodymium (Pr) is preferably used, and the use of Sm is especially desirable. When 50 at % or more of the element R is Sm, performance of the permanent magnet, in particular, its coercive force can be increased with high reproducibility. Further, 70 at % or more of the element R is desirably Sm.

The content p1 of the element R in the composition of the whole sintered compact is in a range of from 10 at % to 13.3 at %. When the content p1 of the element R is less than 10 at %, a large amount of an α-Fe phase precipitates, so that a sufficient coercive force cannot be obtained. When the content p1 of the element R is over 13.3 at %, saturation magnetization greatly lowers. The content p1 of the element R is preferably in a range of from 10.2 at % to 13 at %, and more preferably in a range of from 10.5 at % to 12.5 at %.

Iron (Fe) is an element mainly responsible for magnetization of the permanent magnet. When a relatively large amount of Fe is contained, the saturation magnetization of the permanent magnet can be increased. However, when too large an amount of Fe is contained, the α-Fe phase precipitates and it is difficult to obtain a later-described desired two-phase separation structure, which is liable to lower the coercive force. Therefore, the content q1 of Fe in the composition of the whole sintered compact is in a range of from 25 at % to 40 at %. The content q1 of Fe is preferably in a range of from 27 at % to 38 at %, and more preferably in a range of from 30 at % to 36 at %.

As the element M, at least one element selected from titanium (Ti), zirconium (Zr), and hafnium (Hf) is used. Compounding the element M makes it possible for a large coercive force to be exhibited in a composition with a high Fe concentration. The content r1 of the element M in the composition of the whole sintered compact is in a range of from 0.87 at % to 5.4 at %. By setting the content r1 of the element M to 0.87 at % or more, it is possible to increase the Fe concentration. When the content r1 of the element M is over 5.4 at %, the magnetization greatly lowers. The content r1 of the element M is preferably in a range of from 1.3 at % to 4.3 at %, and more preferably in a range of from 1.5 at % to 2.9 at %.

The element M may be any of Ti, Zr, and Hf, but at least Zr is preferably contained. In particular, when 50 at % or more of the element M is Zr, it is possible to further improve the effect of increasing the coercive force of the permanent magnet. On the other hand, since Hf is especially expensive among the elements M, an amount of Hf used, when it is used, is preferably small. A content of Hf is preferably less than 20 at % of the element M.

Copper (Cu) is an element for making the permanent magnet exhibit a high coercive force and is an element essential for forming the Cu-rich phase. The compounding amount s1 of Cu in the composition of the whole sintered compact is in a range of from 3.5 at % to 13.5 at %. When the compounding amount s1 of Cu is less than 3.5 at %, it is difficult to obtain a high coercive force and further it is difficult to generate the Cu-rich phase, so that a sufficient coercive force and strength cannot be obtained. When the compounding amount s1 of Cu is over 13.5 at %, the magnetization greatly lowers. The compounding amount s1 of Cu is preferably in a range of from 3.9 at % to 9 at %, and more preferably in a range of from 4.2 at % to 7.2 at %.

Cobalt (Co) is an element not only responsible for the magnetization of the permanent magnet but also necessary for a high coercive force to be exhibited. Further, when a large amount of Co is contained, a Curie temperature becomes high, resulting in an improvement in thermal stability of the permanent magnet. When the content of Co is too low, it is not possible to obtain these effects sufficiently. However, when the content of Co is too high, a content ratio of Fe relatively lowers and the magnetization lowers. Therefore, the content of Co is set so that the content of Fe satisfies the aforesaid range, in consideration of the contents of the element R, the element M, and Cu.

A part of Co may be substituted for by at least one element A selected fromnickel (Ni), vanadium (V), chromium (Cr), manganese (Mn), aluminum (Al), gallium (Ga), niobium (Nb), tantalum (Ta), and tungsten (W). These substitution elements A contribute to improvement in properties of the magnet, for example, the coercive force. However, since the excessive substitution by the element A for Co is liable to lower the magnetization, an amount of the substitution by the element A is preferably 20 at % or less of Co.

The permanent magnet of the embodiment includes a sintered magnet made of the sintered compact having the composition expressed by the composition formula 1. The sintered magnet (sintered compact) has, as the main phase, a region including the $Th_2Zn_{17}$ crystal phase. The main phase of the sintered magnet refers to a phase whose area ratio in an observed image (SEM image) when a cross section of the sintered compact is observed by a SEM (Scanning Electron Microscope) is the largest. The main phase of the sintered magnet preferably has a phase separation structure formed by applying aging a $TbCu_7$ crystal phase (1-7 phase) being a high-temperature phase as a precursor. The phase separation structure has a cell phase made of the $Th_2Zn_{17}$ crystal phase (2-17 phase) and a cell wall phase made of a $CaCu_5$ crystal phase (1-5 phase) and the like. Since domain wall energy of the cell wall phase is larger than that of the cell phase, a difference in this domain wall energy becomes a barrier to domain wall displacement. That is, it is thought that the coercive force of a domain wall pinning type is exhibited because the cell wall phase having the large domain wall energy works as a pinning site.

The sintered magnet of the embodiment has the crystal grains each composed of the main phase including the $Th_2Zn_{17}$ crystal phase, and is made of a polycrystalline body (sintered compact) of such crystal grains. Grain boundary phases exist in grain boundaries (crystal grain boundaries) of the crystal grains forming the sintered compact. A size (crystal grain size) of the crystal grains forming the sintered compact is generally on a micron order (for example, about 5 μm to about 500 μm), and a thickness of the grain boundary phases existing in the grain boundaries of such crystal grains is also on a micron order. On the other hand, a size of the cell phase in the main phase is on a nano order (for example, about 50 nm to about 400 nm), and a thickness of the cell wall phase surrounding such a cell phase is also on a nano order (for example, about 2 nm to about 30 nm). The crystal grains forming the sintered magnet are different from the cell phases in the main phases. Similarly, the grain boundary phases existing in the crystal grain boundaries are also different from the cell wall phases surrounding the cell phases. The phase separation structure of the cell phase and the cell wall phase exists in the crystal grains (main phase).

In the Sm—Co based sintered magnet, the metallic structure (structure of the sintered compact) observed by SEM or the like includes various phases (hetero phases) other than the aforesaid main phase. It has been found out that especially the Cu-rich phase, among such hetero phases, which is higher in the Cu concentration than the main phase and its precipitation form mainly influence the strength and the coercive force of the Sm—Co based sintered magnet. Specifically, by making the Cu-rich phases thinly exist in a streak shape in the grain boundaries of the crystal grains forming the sintered magnet, it is possible to suppress the adverse effect that the Cu-rich phases being the hetero phases have on the magnetic properties such as the coercive force stemming from the main phase having the phase separation structure and at the same time, to increase a density of the sintered magnet (sintered compact), and in addition, the Cu-rich phase can prevent the crystal grains from becoming coarse and suppress the progress of their cracks. Consequently, it is possible to improve both the magnetic properties such as the coercive force and the magnetization, and the mechanical property such as the strength of the Sm—Co based sintered magnet.

The sintered magnet (sintered compact) of the embodiment includes the crystal grains each composed of the main phase including the $Th_2Zn_{17}$ crystal phase, and the Cu-rich phase whose average thickness is from 0.05 μm to 2 μm. The Cu-rich phases preferably exist thinly in the streak shape in the grain boundaries of the crystal grains forming the sintered magnet. When the average thickness of the Cu-rich phases is less than 0.05 μm, in other words, when a precipitation amount of the Cu-rich phases in the crystal grain boundaries is insufficient, it is not possible to increase the density of the sintered compact. This results in both the deterioration of the magnetization of the sintered magnet and inability to sufficiently improve its strength. When the average thickness of the Cu-rich phases is over 2 μm, in other words, when the precipitation amount of the Cu-rich phases in the crystal grain boundaries is too large, even though the strength of the sintered magnet can be more increased, an amount of the hetero phases in the sintered magnet increases, and Cu becomes too rich in the Cu-rich phases, resulting in a reduction in the Cu concentration in the main phases. This hinders the phase separation of the main phases and lowers the coercive force of the sintered magnet.

As described above, by making the Cu-rich phases whose average thickness is from 0.05 μm to 2 μm exist in the sintered magnet (sintered compact), it is possible to enhance not only the magnetic properties such as the coercive force and the magnetization of the sintered magnet but also its mechanical properties such as the strength. An alloy forming the Sm—Co based sintered magnet is made of a fragile intermetallic compound, and in the sintered compact of such an alloy, its strength property in particular is likely to deteriorate. A possible cause to deteriorate the strength of the sintered magnet is that plastic deformation does not easily occur in the intermetallic compound. Therefore, when a stress is applied, breakage occurs in the crystal grain boundaries. In order to prevent the breakage ascribable to the stress application, it is effective to increase a yield stress of the alloy. Making the Cu-rich phases with an appropriate thickness exist in the crystal grain boundaries of the sintered compact makes it possible to suppress the breakage of the crystal grain boundaries when the stress is applied. Further, the Cu-rich phases can suppress the progress of the cracks.

Further, when the Cu-rich phases exist in the crystal grain boundaries of the sintered compact, the displacement of the crystal grains at the time of sintering is suppressed, which can prevent the crystal grains from becoming coarse. It is said that the Hall-Petch relation holds between a crystal grain size and strength of the sintered compact, and preventing the crystal grains from becoming coarse results in an improvement in the strength. In addition, the Cu-rich phase also functions as the pinning site of the dislocation, and from this point of view as well, it is thought to contribute to the improvement in the strength of the sintered magnet. Based on these causes, by making the Cu-rich phases with an appropriate thickness exist in the crystal grain boundaries of the sintered compact, it is possible to improve the strength of the Sm—Co based sintered magnet. The average thickness of the Cu-rich phases is more preferably from 0.1 μm to 1.5 μm, and still more preferably 0.15 μm to 1 μm.

The Cu-rich phases have the effect of preventing the coarsening of crystal grains forming the sintered compact. Concretely, an average grain size of the crystal grains forming the sintered compact is preferably in a range of from 35 μm to 200 μm. When the average grain size of the crystal grains is over 200 μm, the strength of the sintered magnet is likely to lower. When the Cu-rich phases having an appropriate thickness exist in the crystal grain boundaries, the crystal grains are prevented from becoming too coarse. Therefore, the average grain size of the crystal grains can be 200 μm or less. However, the crystal grain boundaries are possible to become reversal nucleus of the magnetization. When the crystal grain size is too small, the crystal grain boundaries increase, and accordingly the coercive force and squareness tend to lower. Therefore, the average grain size of the crystal grains is preferably 35 μm or more.

A volume fraction of the Cu-rich phases in the sintered magnet (sintered compact) is preferably in a range of from 0.01% to 5%. When the volume fraction of the Cu-rich phases is over 5%, an amount of the hetero phases in the sintered magnet increases, and the phase separation of the main phases is hindered because Cu becomes too rich in the Cu-rich phases. Therefore, the coercive force of the sintered magnet is liable to lower. When the volume fraction of the Cu-rich phases is less than 0.01%, it is not possible to sufficiently obtain the effect of improving the strength of the sintered compact, and the magnetization of the sintered magnet is also likely to lower. The volume fraction of the Cu-rich phases is more preferably in a range of from 0.03% to 3%, and still more preferably in a range of from 0.05% to 2%.

The Cu-rich phase has a composition expressed by a composition formula 2:

$$R_{p2}Fe_{q2}M_{r2}Cu_{s2}Co_{100-p2-q2-r2-s2},$$

wherein R is at least one element selected from the group consisting of rare-earth elements, M is at least one element selected from the group consisting of Zr, Ti, and Hf, p2 satisfies 10.8 at % p2≤11.6 at %, q2 satisfies 25 at % q2≤40 at %, r2 satisfies 1 at %≤r2≤2 at %, and s2 satisfies 5 at %≤s2≤16 at % and 1<s2/s1.

When the composition of the Cu-rich phase falls out of the range of the composition formula 2, it is not possible to obtain the effect of improving the density and the strength based on the Cu-rich phase. The Cu content (s2) of the Cu-rich phase is more preferably in a range of from 1.5 times to 4 time the Cu content (s1) in the composition of the whole sintered compact (1.5≤s2/s1≤4). This makes it possible to more effectively improve the strength of the sintered magnet while more favorably maintaining the coercive force of the sintered magnet.

A relation of the appearance of the Cu-rich phase with the strength and the magnetic property in the Sm—Co based sintered magnet will be described in detail. The Sm—Co based sintered magnet is fabricated in such a manner that raw materials such as Sm and Co are melted to form an alloy ingot, the alloy ingot is ground and the resultant powder is sintered after being compression-molded in a magnetic field. The alloy ingot includes various phases (hetero phases) other than the 2-17 phase being the main phase as shown in the SEM-reflected electron image in FIG. 1. The hetero phases tend to be more likely to precipitate as the Fe concentration is higher. When the sintered compact is fabricated by using the alloy powder including such various phases, its sintering process is expected to become more complicated compared with a case where alloy powder with a small amount of hetero phases is used. Specifically, when melting points of the main phase and the hetero phase greatly differ from each other, it is thought that the phase having the lower melting point melts in a heating-up process at the time of the sintering, and become a liquid phase. In this case, it is thought that the sintering progresses in a process similar to sintering in which the liquid phase is involved, that is, similar to liquid-phase sintering.

An amount of the hetero phases in the alloy powder (raw material powder) tends to increase as the Fe concentration becomes higher. For a composition range with a high Fe concentration, establishment of a sintering method considering the liquid phase resulting from the melting of the hetero phases, to which no consideration has been necessary for a conventional composition, is thought tote required. Here, a metallic structure in the middle stage of the sintering process of alloy powder was examined in details and a method of controlling the metallic structure in order to realize higher density was studied. The sintering of a Sm—Co based magnet is generally performed at a temperature of about 1170° C. to about 1230° C. Compression-molded sample of the alloy powder was heated up to a temperature lower than the sintering temperature and was held at the temperatures for a predetermined time, and thereafter, was rapidly-cooled from the temperature. The sample whose metallic structure in the course of the rising temperature was kept up to room temperature was fabricated. The plural samples held at the varied temperatures ware fabricated, and the metallic structures of these samples were compared. The alloy powder having a Sm—Zr—Cu—Fe—Co-based composition was used.

When the metallic structure (microstructure) of the samples was observed, the existence of phases other than the 2-17 phase being the main phase was confirmed. More careful observation of the hetero phases made it clear that several kinds of hetero phases existed. Concretely, it was confirmed that an oxide of Sm, an ultra Zr-rich phase whose Zr concentration was 80% or more, a Sm—Zr-rich phase higher in the Sm concentration and the Zr concentration than the main phase, a Cu—Zr-rich phase higher in the Cu concentration and the Zr concentration than the main phase, a Cu-rich phase higher only in the Cu concentration than the main phase, and so on existed. It was made clear that a condition at the time of the rising temperature of the sintering process greatly influences a precipitation form of especially the Cu-rich phase among these hetero phases. It has been further found out that the density and the strength of the sintered compact greatly depend on a precipitation state of the Cu-rich phase.

Figure 2:
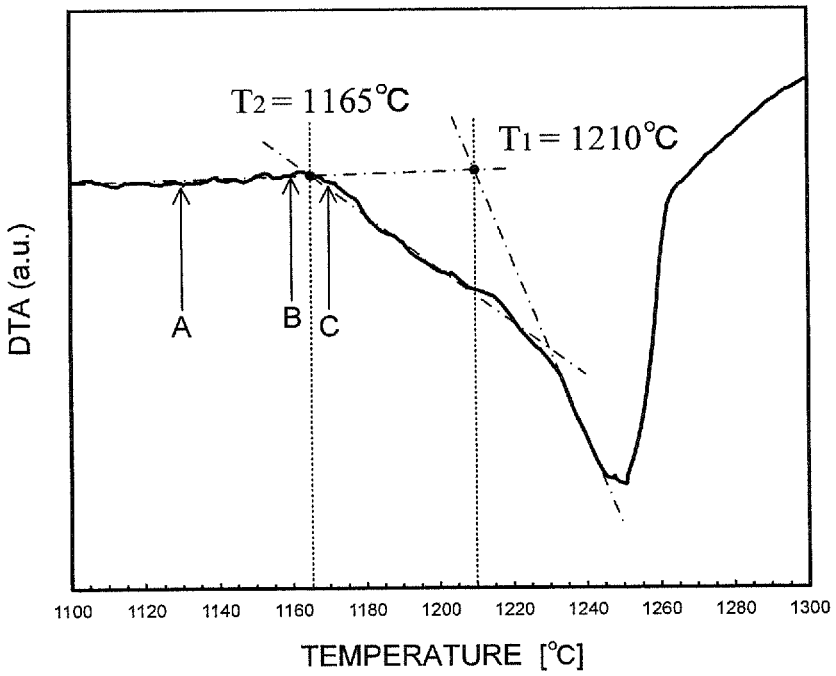
FIG. 2 is a chart showing an example of a differential thermal analysis of alloy powder used for fabricating the Sm—Co based sintered magnet.

It is possible to control the precipitation state of the Cu-rich phase by adjusting the condition at the time of the rising temperature of the sintering process. Further, controlling the precipitation state of the Cu-rich phase enables an improvement in the density, the strength, and so on of the sintered compact (sintered magnet). The precipitation state of the Cu-rich phase can be controlled especially by an atmosphere at the time of the rising temperature. Concretely, by setting the atmosphere to a vacuum atmosphere until the middle of the rising temperature, changing the atmosphere to an inert gas atmosphere such as Ar gas at a specific temperature close to the sintering temperature, and subsequently performing the sintering, it is possible to generate the Cu-rich phase in an appropriate form. The temperature at which the change from the vacuum atmosphere to the inert gas atmosphere takes place is preferably controlled based on a phase state of the raw material powder. The result of thermal analysis by differential thermal analysis (DTA) of the raw material powder is shown in FIG. 2. As is seen from FIG. 2, large endothermic peaks exist in the vicinity of 1210° C. to 1250° C., and they are thought to be endothermic peaks due to the melting of the main phase.

In the result of the thermal analysis of the Sm—Zr—Cu—Fe—Cu-based alloy powder having a high Fe concentration shown in FIG. 2, it is further confirmed that the curve sharply rises from around 1165° C. in the vicinity of the maximum peak and the endothermic peak is occurring. This maximum peak has an inflection point in the middle of the rising temperature (near 1210° C.), and it can be seen that the curve rises steeper. The maximum peak is thought to be the endothermic peak due to the melting of the main phase. When an intersection point $T_1$ of a tangent at a position where the rise of the endothermic peak is steepest and a base line is found, it is about 1210° C. This is thought to be a reasonable temperature as a melting point expected from the alloy system. From these, it is thought that two phase transformations or more are occurring. Further, it is thought that a melting point of the phase different from the main phase exists on a low-temperature side (around 1165° C.).

Figure 3A:
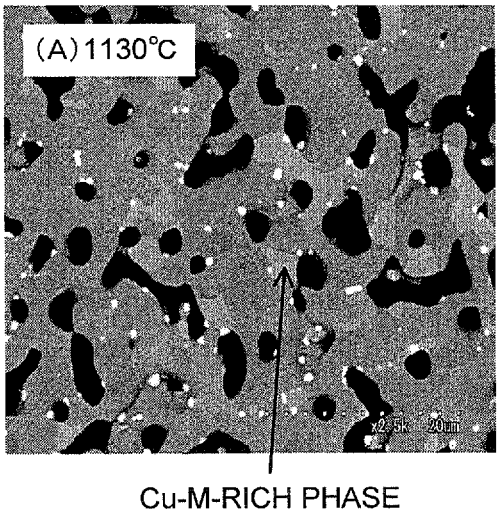
FIG. 3A to FIG. 3C are SEM-reflected electron images showing metallic structures of samples obtained by heating up compression-molded bodies of the alloy powder shown in FIG. 2 to temperatures lower than a sintering temperature.
Figure 3B:
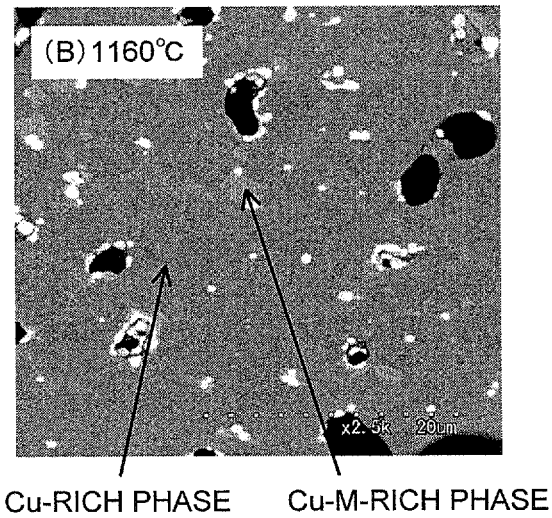
Figure 3C:
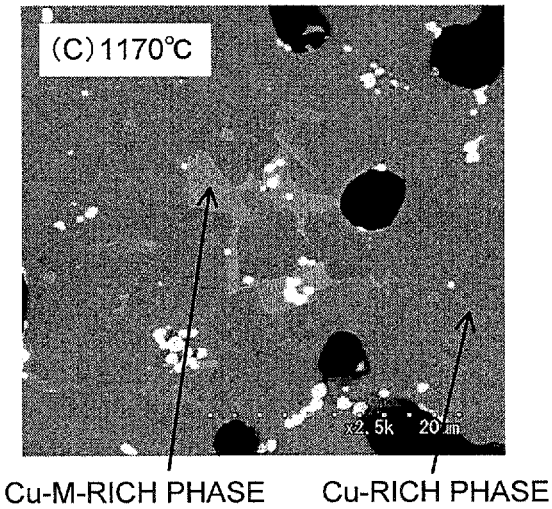
Figure 4A:
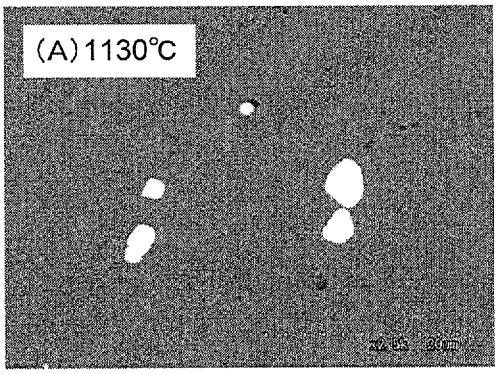
FIG. 4A to FIG. 4C are SEM-reflected electron images showing metallic structures of samples obtained by heating up the samples shown in FIG. 3A to FIG. 3C to a sintering temperature.
Figure 4B:
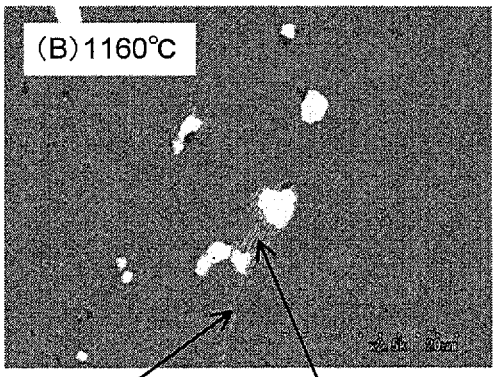
Figure 4C:
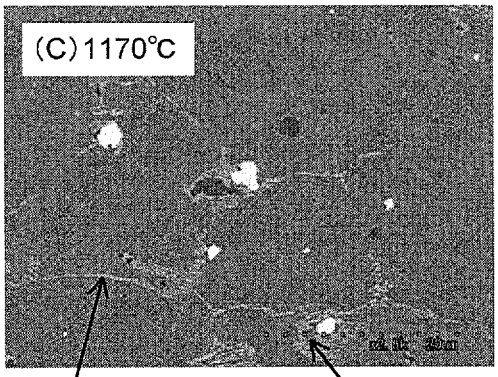

Compression-molded bodies of the aforesaid alloy powder were heated up to 1160° C. (3) near the temperature at which the thermal analysis curve rises, up to 1130° C. (A) lower than 1160° C. by 30° C., and up to 1170° C. (C) higher than 1160° C. by 10° C. respectively in a vacuum atmosphere, and kept at the respective temperatures for one minute, and thereafter, they were rapidly cooled in an Ar gas atmosphere. The samples having metallic structures in the course of the rising temperature were fabricated. FIG. 3A, FIG. 3B, and FIG. 3C show SEM-reflected electron images of the respective samples. In the sample (1130° C. material) which was heated up to 1130° C. (A), besides a Sm oxide, only a Cu-M-rich phase appeared as the phase other than the main phase. In the sample (1160° C. material) which was heated up to 1160° C. (B) and the sample (1170° C. material) which was heated up to 1170° C. (C), a Cu-rich phase further appeared. These samples were heated up to the sintering temperature in the Ar gas atmosphere, whereby samples (sintered materials) having sintered structures were fabricated. FIG. 4A, FIG. 4B, and FIG. 4C show SEM-reflected electron images of the respective samples (sintered materials).

As is apparent from FIG. 4A to FIG. 4C, a generation state of the Cu-rich phase differs. In the sintered material of the 1130° C. material, no generation of the Cu-rich phase was confirmed. In the sintered material of the 1160° C. material, a minute amount of the Cu-rich phase precipitated in a plate shape in a crystal grain boundary and its thickness was about 0.15 μm. In the sintered material of the 1170° C. material, a thickness of the Cu-rich phase increased up to about 0.5 μm. When mechanical properties of these samples were evaluated by measuring deflective strength by a three-point bending test, the deflective strength had a low value of 60 MPa in the sintered material of the 1130° C. material, while it had a high value of 100 MPa in the sintered material of the 1160° C. material, and it had a still higher value of 115 MPa in the sintered material of the 1170° C. material. The sintered material of the 1130° C. material is low in density and accordingly also low in magnetization. The sintered materials of the 1160° C. material and the 1170° C. material had sufficient density. A coercive force of the sintered material of the 1170° C. material was slightly lower than that of the sintered material of the 1160° C. material. Further increasing the temperature at which the vacuum atmosphere is changed to the Ar gas atmosphere tended to result in an increase in the thickness of the Cu-rich phase and a further decrease in the coercive force.

By adjusting the temperature at which the vacuum atmosphere is changed to the inert gas atmosphere such as the Ar gas atmosphere in the course of the rising temperature of the sintering step, based on the temperature at which the endothermic peak appearing between 1100° C. and 1220° C. rises in the DTA curve obtained in the differential thermal analysis, it is possible to control the presence/absence of the precipitation of the Cu-rich phase in the sintered compact and further the precipitation form (including the precipitation amount) of the Cu-rich phase. By heating up to the temperature in the vacuum atmosphere nearly to the temperature at which the aforesaid endothermic peak rises and performing the sintering after the atmosphere is changed to the inert gas atmosphere such as the Ar gas atmosphere, it is possible to precipitate the Cu-rich phases having appropriate thickness and amount in the crystal grain boundaries of the sintered compact. Therefore, it is possible to improve the strength and the coercive force of the sintered compact (sintered magnet).

In the permanent magnet of this embodiment, the element concentrations such as the Cu concentration in the main phase and the Cu-rich phase can be measured by SEM-EDX (SEM-Energy Dispersive X-ray Spectroscopy). The SEM-EDX observation is conducted for an interior of the sintered compact. The measurement of the interior of the sintered compact is as follows. The composition is measured in a surface portion and the interior of a cross section cut at a center portion of the longest side in a surface having the largest area, perpendicularly to the side (perpendicularly to a tangent of the center portion in a case of a curve).

Measurement points are as follows. Reference lines 1 drawn from ½ positions of respective sides in the aforesaid cross section as starting points up to end portions toward an inner side perpendicularly to the sides and reference lines 2 drawn from centers of respective corners as starting points up to end portions toward the inner side at ½ positions of interior angles of the corners are provided, and 1% positions of the lengths of the reference lines from the starting points of these reference lines 1, 2 are defined as the surface portions and 40% positions thereof are defined as the interior. Note that, when the corners have curvature because of chamfering or the like, points of intersection of extensions of adjacent sides are defined as the end portions (centers of the corners). In this case, the measurement points are positions determined not based on the points of intersection but based on portions in contact with the reference lines.

When the measurement points are decided as above, in a case where the cross section is, for example, a quadrangular, the number of the reference lines is totally eight, with the four reference lines 1 and the four reference lines 2, and the number of the measurement points is eight in each of the surface portion and the interior. In this embodiment, the eight points in each of the surface portion and the interior all preferably have the composition within the aforesaid range, but at least four points or more in each of the surface portion and the interior need to have the composition within the aforesaid range. In this case, a relation between the surface portion and the interior of one reference line is not defined. The SEM observation with a magnification of ×2500 is conducted after an observation surface of the interior of the sintered compact thus defined is smoothed by polishing. An acceleration voltage is desirably 20 kV. Observation points of the SEM-EDX are arbitrary 20 points in the crystal grains, and an average value of measurement values at these points is found, and this average value is set as the concentration of each element.

The thickness of the Cu-rich phase is found in the following manner. Specifically, by using a SEM-reflected electron image photographed with a magnification of ×2500, a point where crystal grain boundaries of at least three adjacent crystal grains intersect (for example, a triple point when three crystal grains intersect) is specified, and further a position of a center of the crystal grain boundary between adjacent intersection points is specified. In a state where the magnification of the SEM-reflected electron image is increased to 5000 times, the thickness of the crystal grain boundary (Cu-rich phase) at the specified center position is measured. The thickness of the crystal grain boundary is a thickness in a direction perpendicular to a grain boundary direction. Such measurement is conducted for twenty points, and an average value of their values is defined as the thickness of the Cu-rich phase.

The volume fraction of the Cu-rich phase is defined by an area ratio of the Cu-rich phase in a field of view observed by EPMA (Electron Probe Micro Analyser). The area ratio of the Cu-rich phase can be found in the following manner. First, a BSE image with a magnification of ×2500 is photographed by EPMA of a field emission (FE) type. After a specific contrast is extracted from the photographed image by using two threshold values by image analysis software or the like available on the market, an area is calculated. The extraction of the contrast means that two certain "threshold values" are set for brightness (lightness) of each pixel of the image, and a region is discriminated in such a manner that "0" is set when the brightness is equal to or less than the threshold value A or equal to or more than the threshold value B, and "1" is set when the brightness is equal to or more than the threshold value A and equal to or less than the threshold value B. As the threshold values, the minimum values of brightness to be extracted on both sides of its distribution are used, and this region is selected. When the distribution of the brightness overlaps with another contrast, the minimum values of the both brightnesses are used as the threshold values, and this region is selected.

The average grain size (average crystal grain size) of the crystal grains forming the sintered compact (sintered magnet) can be measured by SEM-EBSP (SEM-Electron Backscattering Pattern). The procedure for finding the average grain area and the average grain size of the crystal grains existing in the measurement area will be shown below. First, as a pre-process, a sample is embedded in epoxy resin, mechanically polished, and subjected to buffed finish, followed by water washing and water spraying by air-blow. The sample having undergone the water spraying is surface-treated by a dry etching apparatus. Next, a surface of the sample is observed by a scanning electron microscope S-4300SE (manufactured by Hitachi High Technologies, Inc.) to which EBSD system-Digiview (manufactured by TSL Corporation) is attached. As observation conditions, the acceleration voltage is 30 kV and the measurement area is 500 μm×500 μm. From the observation result, the average grain area and the average grain size of the crystal grains existing in the measurement area are found under the following condition.

Orientations of all the pixels in the measurement area range are measured with a 2 μM step size, and a boundary where an orientation error between the adjacent pixels is 5° or more is regarded as the crystal grain boundary. However, a crystal grain where the number of measurement points included in the same crystal grain is less than five and a crystal grain reaching an end portion of the measurement area range are not regarded as the crystal grains. The grain area is an area in the same crystal grain surrounded by the crystal grain boundary, and the average grain area is an average value of the areas of the crystal grains existing in the measurement area range. The grain size is a diameter of a complete circle having the same area as the area in the same crystal grain, and the average grain size is an average value of the grain sizes of the crystal grains existing in the measurement area range.

The permanent magnet of this embodiment is fabricated as follows, for instance. First, alloy powder containing predetermined amounts of elements is fabricated. The alloy powder is prepared by forming an alloy ingot obtained through the forging of molten metal melted by, for example, an arc melting method or a high-frequency melting method and grinding the alloy ingot. Other examples of the method of preparing the alloy powder are a strip cast method, a mechanical alloying method, a mechanical grinding method, a gas atomization method, a reduction diffusion method, and the like. The alloy powder prepared by any of these methods may be used. The alloy powder thus obtained or the alloy before being ground may be heat-treated for homogenization when necessary. A jet mill, a ball mill, or the like is used for grinding the flake or the ingot. The grinding is preferably performed in an inert gas atmosphere or an organic solvent in order to prevent oxidization of the alloy powder.

Next, the alloy powder is filled in a mold installed in an electromagnet or the like and it is press-formed while a magnetic field is applied, whereby a compression-molded body whose crystal axis is oriented is fabricated. By sintering this compression-molded body under an appropriate condition, it is possible to obtain a sintered compact having high density. The sintering of the compression-molded body is preferably performed by combining the sintering in a vacuum atmosphere and the sintering in an atmosphere of inert gas such as Ar gas. In this case, it is preferable that the compression-molded body is heated up to a predetermined temperature in the vacuum atmosphere, and is heated up to a predetermined sintering temperature after the atmosphere is changed from the vacuum atmosphere to the inert gas atmosphere. The temperature at which the vacuum atmosphere is changed to the inert gas atmosphere is preferably set based on the temperature at which the endothermic peak appearing between 1100° C. and 1220° C. in the DTA curve rises as described above.

When the temperature at which the endothermic peak rises in the DTA curve is Tp [° C.], and the temperature at which the vacuum atmosphere is changed to the inert gas atmosphere is T [° C.], the temperature T is preferably set so as to satisfy "Tp−25[° C.]<T<Tp+25[° C.]". If the temperature T is "Tp−25[° C.]" or lower, it is not possible to sufficiently generate the Cu-rich phases in the crystal grain boundaries, and the density and the strength of the sintered compact cannot be increased. If the temperature T is "Tp+25[° C.]" or higher, the coercive force of the sintered magnet lowers. The atmosphere change temperature T is more preferably in a range of "Tp−15[° C.]<T<Tp+15[° C.]", and still more preferably in a range of "Tp−10[° C.]<T<Tp+10[° C.]".

A degree of vacuum when the compression-molded body is heated up in the vacuum atmosphere is preferably $9\times10^{-2}$ Pa or less. When the degree of vacuum is over $9\times10^{-2}$ Pa, an oxide of Sm or the like is excessively formed and the magnetic properties lower. Further, heating up in the vacuum atmosphere with $9\times10^{-2}$ Pa or less enables more effective control of the generation of the Cu-rich phases. The degree of vacuum is more preferably $5\times10^{-2}$ Pa or less, and still more preferably $1\times10^{-2}$ Pa or less. Further, when the vacuum atmosphere is changed to the inert gas atmosphere, the retention for a predetermined time is also effective, which can more increase the effect of improving the density and the strength. The retention time is preferably one minute or more, more preferably five minutes or more, and still more preferably twenty-five minutes or more. However, when the retention time is too long, a magnetic force is liable to lower due to the evaporation of Sm or the like, and therefore, the retention time is preferably sixty minutes or less.

The sintering temperature in the inert gas atmosphere is preferably 1215° C. or lower. When the Fe concentration is high, it is expected that a melting point becomes lower. Therefore, when the sintering temperature is too high, the evaporation of Sm or the like is likely to occur. The sintering temperature is more preferably 1205° C. or lower, and still more preferably 1195° C. or lower. However, in order to increase the density of the sintered compact, the sintering temperature is preferably 1170° C. or higher, and more preferably 1180° C. or higher. The retention time at the sintering temperature is preferably 0.5 hours to fifteen hours. This makes it possible to obtain a dense sintered compact. When the sintering time is less than 0.5 hours, the density of the sintered compact becomes non-uniform. When the sintering time is over fifteen hours, it is not possible to obtain a good magnetic property due to the evaporation of Sm or the like. The sintering time is more preferably one hour to ten hours, and still more preferably one hour to four hours.

The solution heat treatment and the aging treatment are applied to the obtained sintered compact to control the crystal structure. The solution heat treatment is preferably performed by heating at a temperature of 1100° C. to 1190° C. for 0.5-hour to sixteen-hour in order to obtain the 1-7 phase being the precursor of the phase separation structure. When the temperature is lower than 1100° C. or is over 1190° C., a ratio of the 1-7 phase in the sample after the solution heat treatment is small, and a good magnetic property cannot be obtained. The temperature of the solution heat treatment is more preferably in a range of 1120° C. to 1180° C., and still more preferably in a range of 1120° C. to 1170° C. When the time of the solution heat treatment is less than 0.5 hours, the constituent phase is likely to be non-uniform, and when it is over sixteen hours, Sm or the like in the sintered compact evaporates and a good magnetic property may not be obtained. The time of the solution heat treatment is more preferably in a range of one hour to fourteen hours, and still more preferably in a range of three hours to twelve hours. The solution heat treatment is preferably conducted in a vacuum atmosphere or an inert gas atmosphere in order to prevent the oxidization.

The sintered compact after the solution heat treatment is subjected to the aging treatment. The aging treatment is a process to control the crystal structure and increase the coercive force of the magnet. The aging treatment is preferably performed by heating at a temperature of 700° C. to 900° C. for the four hours to eighty hours, and followed by gradual cooling to a temperature of 300° C. to 650° C. at a cooling rate of 0.2° C./minute to 2° C./minute, and subsequent cooling to room temperature by furnace cooling. The aging treatment may be performed by two-stage heat treatment. For example, the aforesaid heat treatment is the first stage, and thereafter, as the second-stage heat treatment, the sintered compact is held at 300° C. to 650° C. for a predetermined time, and it is subsequently cooled to room temperature by furnace cooling. The aging treatment is preferably performed in a vacuum atmosphere or an inert gas atmosphere in order to prevent the oxidization.

When the aging temperature is lower than 700° C. or is higher than 900° C., it is not possible to obtain a uniform mixed structure of the cell phase and the cell wall phase, which is liable to lower the magnetic property of the permanent magnet. The aging temperature is more preferably 750° C. to 880° C., and still more preferably 780° C. to 860° C. When the aging time is less than four hours, the precipitation of the cell wall phase from the 1-7 phase may not be completed sufficiently. When the aging time is over eighty hours, a thickness of the cell wall phase becomes large to reduce the volume fraction of the cell phase, or the crystal grains become coarse, so that a good magnetic property may not be obtained. The aging time is more preferably six hours to sixty hours, and still more preferably eight hours to forty-five hours.

When the cooling rate after the aging treatment is less than 0.2° C./minute, the thickness of the cell wall phase becomes large to lower the volume fraction of the cell phase, or the crystal grains become coarse, so that a good magnetic property may not be obtained. When the cooling rate after the aging treatment is over 2° C./minute, it is not possible to obtain a uniform mixed structure of the cell phase and the cell wall phase, so that the magnetic property of the permanent magnet is liable to deteriorate. The cooling rate after the aging treatment is more preferably in a range of 0.4° C./minute to 1.5° C./minute, and still more preferably in a range of 0.5° C./minute to 1.3° C./minute.

Note that the aging is not limited to the two-stage heat treatment and may be a more multiple-stage heat treatment, and performing multiple-stage cooling is also effective. Further, it is also effective to perform preliminary aging at a lower temperature for a shorter time than those of the aging treatment as a pre-process of the aging treatment. Consequently, it is expected that the squareness of a magnetization curve is improved. Concretely, in the preliminary aging, when the temperature is from 650° C. to 790° C., the time is from 0.5 hours to four hours, and the gradual cooling rate is from 0.5° C./minute to 1.5° C./minute, it is expected that the squareness of the permanent magnet is improved.

The permanent magnet of this embodiment is usable in various kinds of motors and power generators. The permanent magnet of the embodiment is also usable as a stationary magnet and a variable magnet of a variable magnetic flux motor and a variable magnetic flux power generator. Various kinds of motors and power generators are structured by the use of the permanent magnet of this embodiment. When the permanent magnet of this embodiment is applied to a variable magnetic flux motor, arts disclosed in Japanese Patent Application Laid-open No. 2008-29148 and Japanese Patent Application Laid-open No. 2008-43172 are applicable as a structure and a drive system of the variable magnetic flux motor.

Figure 5:
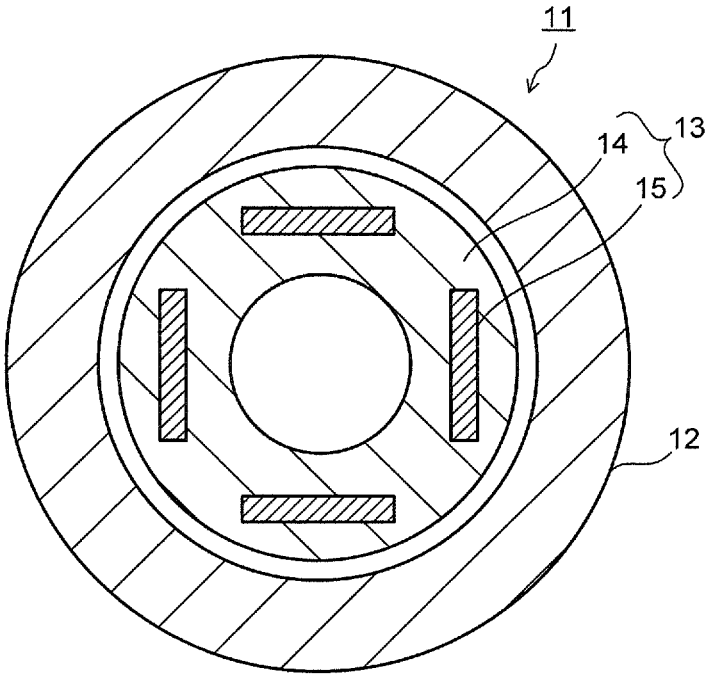
FIG. 5 is a view showing a permanent magnet motor of an embodiment.

Next, a motor and a power generator of embodiments will be described with reference to the drawings. FIG. 5 shows a permanent magnet motor according to an embodiment. In the permanent magnet motor 11 shown in FIG. 5, a rotor (rotating part) 13 is disposed in a stator (stationary part) 12. In an iron core 14 of the rotor 13, the permanent magnets 15 of the embodiment are disposed. Based on the properties and so on of the permanent magnets of the embodiment, it is possible to realize efficiency enhancement, downsizing, cost reduction, and so on of the permanent magnet motor 11.

Figure 6:
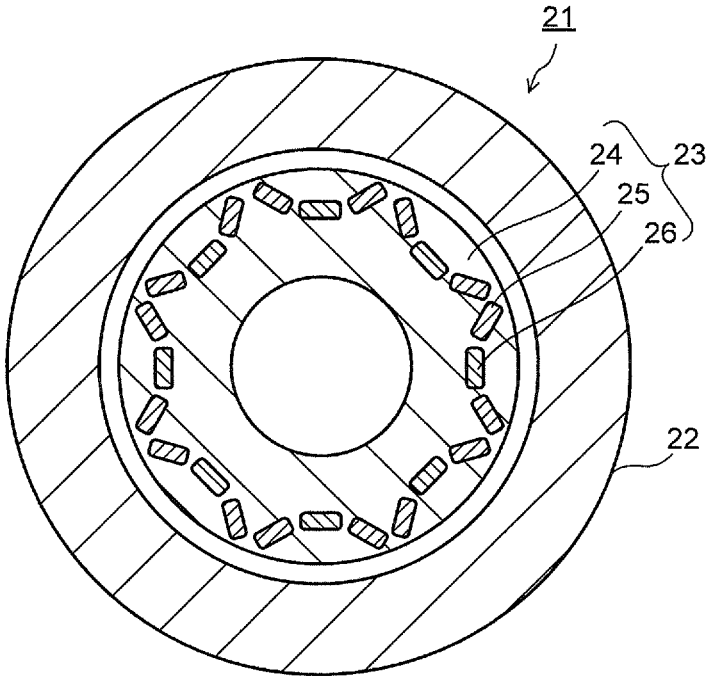
FIG. 6 is a view showing a variable magnetic flux motor of an embodiment.

FIG. 6 shows a variable magnetic flux motor according to an embodiment. In the variable magnetic flux motor 21 shown in FIG. 6, a rotor (rotating part) 23 is disposed in a stator (stationary part) 22. In an iron core 24 of the rotor 23, the permanent magnets of the embodiment are disposed as stationary magnets 25 and variable magnets 26. Magnetic flux density (flux quantum) of the variable magnets 26 is variable. The variable magnets 26 are not influenced by a Q-axis current because their magnetization direction is orthogonal to a Q-axis direction, and can be magnetized by a D-axis current. In the rotor 23, a magnetized winding (not shown) is provided. When a current is passed through the magnetized winding from a magnetizing circuit, the magnetic field acts directly on the variable magnets 26.

According to the permanent magnet of the embodiment, it is possible to obtain, for example, the stationary magnet 25 whose coercive force is over 500 kA/m and the variable magnet 26 whose coercive force is equal to or lower than 500 kA/m, by changing the various conditions of the aforesaid manufacturing method. In the variable magnetic flux motor 21 shown in FIG. 6, the permanent magnets of the embodiment are usable as both of the stationary magnets 25 and the variable magnets 26, but the permanent magnets of the embodiment may be used as either of the magnets. The variable magnetic flux motor 21 is capable of outputting a large torque with a small device size and thus is suitable for motors of hybrid vehicles, electric vehicles, and so on whose motors are required to have a high output and a small size.

Figure 7:
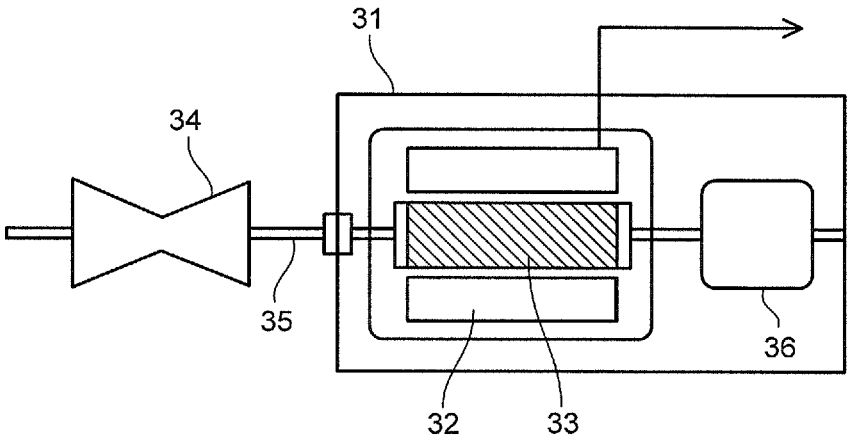
FIG. 7 is a view showing a permanent magnet power generator of an embodiment.

FIG. 7 shows a power generator according to an embodiment. The power generator 31 shown in FIG. 7 includes a stator (stationary part) 32 using the permanent magnet of the embodiment. A rotor (rotating part) 33 disposed inside the stator (stationary part) 32 is connected via a shaft 35 to a turbine 34 provided at one end of the power generator 31. The turbine 34 rotates by an externally supplied fluid, for instance. Incidentally, instead of the turbine 34 rotating by the fluid, it is also possible to rotate the shaft 35 by the transmission of dynamic rotation such as regenerative energy of a vehicle. As the stator 32 and the rotor 33, various kinds of generally known structures are adoptable.

The shaft 35 is in contact with a commutator (not shown) disposed on the rotor 33 opposite the turbine 34, and an electromotive force generated by the rotation of the rotor 33 is boosted to system voltage to be transmitted as an output of the power generator 31 via an isolated phase bus and a traction transformer (not shown). The power generator 31 may be either of an ordinary power generator and a variable magnetic flux power generator. Incidentally, the rotor 33 is electrically charged due to static electricity from the turbine 34 or an axial current accompanying the power generation. Therefore, the power generator 31 includes a brush 36 for discharging the charged electricity of the rotor 33.

Next, examples and their evaluation results will be described.

EXAMPLES 1, 2

Raw materials were weighed so that the compositions became as shown in Table 1, and the resultants were high-frequency-melted in an Ar gas atmosphere, whereby alloy ingots were fabricated. The alloy ingots were roughly ground and then finely ground by a jet mill, whereby alloy powders were prepared. Differential thermal analysis was conducted on the obtained alloy powders, and a temperature Tp at which an endothermic peak (maximum peak) appearing between 1100° C. and 1220° C. in a DTA curve rose was found by the aforesaid method. For the measurement of the DTA curve, a differential thermal balance TGD-7000 type (manufactured by ULVAC-RIKO, Inc.) was used. A range of the temperature measured was from room temperature to 1650° C., a heating rate was 10° C./minute, and an atmosphere was Ar gas (flow rate 100 mL/minute). Amounts of samples were about 300 mg, and they were each housed in an alumina container at the time of the measurement. Alumina was used as a reference. The peak rising temperatures Tp of the allow powders are shown in Table 2.

Next, the alloy powders were press-formed in a magnetic field, whereby compression-molded bodies were fabricated. The compression-molded bodies of the alloy powders were each disposed in a chamber of a firing furnace, and the inside of the chamber was vacuumed until a degree of vacuum became $9.5\times10^{-3}$ Pa. In this state, the temperature in the chamber was raised up to temperatures T (atmosphere change temperatures) shown in Table 2 and the chamber was kept at the temperatures for five minutes, and thereafter Ar gas was led into the chamber. The temperature in the chamber set to the Ar atmosphere was raised up to 1195° C., and the sintering was performed while this temperature was kept for three hours, and subsequently, the solution heat treatment was performed while the chamber was kept at 1165° C. for six hours. Sintered compacts obtained after the solution heat treatment were held at 720° C. for four hours and thereafter were gradually cooled to room temperature, and were further held at 840° C. for twenty-five hours. The sintered compacts having undergone the aging treatment under such a condition were gradually cooled to 400° C. at a cooling rate of 0.4° C./minute, and were further furnace-cooled to room temperature, whereby aimed sintered magnets were obtained.

The compositions of the sintered magnets are as shown in Table 1. Composition analysis of the magnets was conducted by an ICP (Inductively Coupled Plasma) method. Following the aforesaid method, an average thickness, a volume fraction, and a composition of a Cu-rich phase in each of the sintered magnets (sintered compacts), and sintered density were measured. Magnetic properties of the sintered magnets were evaluated by a BH tracer and their coercive force and residual magnetization were measured. Deflective strength of each of the sintered magnets (sintered compacts) was measured according to the method shown below. Measurement results thereof are shown in Table 3 and Table 4. When an average crystal grain size of each of the sintered compacts was found, it was confirmed that the average crystal grain size was within the aforesaid range of 35 μm to 200 μm.

The composition analysis by the ICP method was done in the following procedure. First, samples taken from the aforesaid measurement points are ground in a mortar, and a predetermined amount of each of the ground samples is weighed and is put into a quartz beaker. A mixed acid (containing nitric acid and hydrochloric acid) is put into the quartz beaker, which is heated to about 140° C. on a hotplate, whereby the samples are completely melted. After they are left standing to cool, they are each transferred to a PFA volumetric flask and their volumes are determined to produce sample solutions. Quantities of components of such sample solutions are determined by a calibration curve method with the use of an ICP emission spectrochemical analyzer. As the ICP emission spectrochemical analyzer, SPS4000 (trade name) manufactured by SII Nano Technology Inc. was used.

The deflective strength of each of the sintered compacts was measured by using a three-point bending testing machine Rin-MICI-07 (manufactured by Matsuzawa-sha). The measured samples are fabricated according to the JIS Standard in such a manner that bar-shaped test pieces with a 4.0 mm width×a 3.0 mm thickness×a 47 mm length are cut out from each of the sintered compact samples having undergone the aging treatment. Five bar-shaped samples are cut out from the same block as much as the situation allows. If it is difficult to cut them out, five pieces are prepared by being cut out from sintered compacts fabricated under the same condition. Sample surfaces are polished by sandpaper of about #400 to be brought into a state where no obvious scratch is seen. An inter-fulcrum distance is set to 40 mm and a load application rate is set to 0.5 mm/minute. The test is conducted at room temperature. An average value of measurement values of the five samples is defined as the deflective strength σb3.

EXAMPLES 3 TO 4

Raw materials were weighed so that the compositions became as shown in Table 1, and the resultants were arc-melted in an Ar gas atmosphere, whereby alloy ingots were fabricated. The alloy ingots were roughly ground after heat-treated under a condition of 1175° C.×twelve hours, and then finely ground by a jet mill, whereby alloy powders were prepared. Peak rising temperatures Tp of the allow powders were found as in the example 1. Next, the alloy powders were press-formed in a magnetic field, whereby compression-molded bodies were fabricated. The compression-molded bodies of the alloy powders were each disposed in a chamber of a firing furnace, and the inside of the chamber was vacuumed until a degree of vacuum became $5.0\times10^{-3}$ Pa. The temperature in the chamber was raised up to temperatures T shown in Table 2 (atmosphere change temperatures), and the chamber was kept at these temperatures for fifteen minutes, and thereafter Ar gas was led into the chamber and the temperature in the chamber was raised up to 1180° C. and the sintering was performed while this temperature was kept for three hours, and subsequently, the solution heat treatment was performed while the chamber was kept at 1135° C. for twelve hours.

Next, the sintered compacts having undergone the solution heat treatment were held at 750° C. for two hours and thereafter were gradually cooled to room temperature, and were further held at 810° C. for forty-five hours. Thereafter, the sintered compacts were gradually cooled to 400° C. and held at this temperature for one hour, and were furnace-cooled to room temperature, whereby aimed sintered magnets were obtained. The compositions of the sintered magnets are as shown in Table 1. An average thickness, a volume fraction, and a composition of a Cu-rich phase in each of the sintered magnets (sintered compacts), and density, a coercive force, residual magnetization, and deflective strength of each of the sintered magnets were measured in the same manners as those of the example 1. Measurement results thereof are shown in Table 3 and Table 4. When an average crystal grain size of each of the sintered compacts was found, it was confirmed that the average crystal grain size was within the aforesaid range of 35 μm to 200 μm.

EXAMPLES 5 TO 7

Raw materials were weighed so that the compositions became as shown in Table 1, and the resultants were high-frequency-melted in an Ar gas atmosphere, whereby alloy ingots were fabricated. The alloy ingots were roughly ground after heat-treated under a condition of 1160° C.×eight hours, and then finely ground by a jet mill, whereby alloy powders were prepared. Peak rising temperatures Tp of the allow powders were found as in the example 1. Next, the alloy powders were press-formed in a magnetic field, whereby compression-molded bodies were fabricated. The compression-molded bodies of the alloy powders were each disposed in a chamber of a firing furnace, and the inside of the chamber was vacuumed until a degree of vacuum became $9.0\times10^{-3}$ Pa. The temperature in the chamber was raised up to temperatures T (atmosphere change temperatures) shown in Table 2, and the chamber was kept at the temperatures for three minutes, and thereafter Ar gas was led into the chamber and the temperature in the chamber was raised up to 1190° C. and the sintering was performed while this temperature was kept for four hours, and subsequently, the solution heat treatment was performed while the chamber was kept at 1130° C. for twelve hours.

Next, the sintered compacts having undergone the solution heat treatment were held at 690° C. for four hours and thereafter were gradually cooled to room temperature, and were further held at 850° C. for twenty hours. Thereafter, the sintered compacts were gradually cooled to 350° C. and were furnace-cooled to room temperature, whereby aimed sintered magnets were obtained. The compositions of the sintered magnets are as shown in Table 1. An average thickness, a volume fraction, and a composition of a Cu-rich phase in each of the sintered magnets (sintered compacts), and density, a coercive force, residual magnetization, and deflective strength of each of the sintered magnets were measured in the same manners as those of the example 1. Measurement results thereof are shown in Table 3 and Table 4. When an average crystal grain size of each of the sintered compacts was found, it was confirmed that the average crystal grain size was within the aforesaid range of 35 μm to 200 μm.

COMPARATIVE EXAMPLES 1 AND 2

Sintered magnets were fabricated in the same manner as that of the example 1 except that the compositions shown in Table 1 were employed. In a comparative example 1, a Fe concentration in the alloy composition is set to less than 25 at %, and in a comparative example 2, a Sm concentration in the alloy composition is set to less than 10 at %. An average thickness, a volume fraction, and a composition of a Cu-rich phase in each of the sintered magnets (sintered compacts), and density, a coercive force, residual magnetization, and deflective strength of each of the sintered magnets were found in the same manners as those of the example 1. Measurement results thereof are shown in Table 3 and Table 4.

COMPARATIVE EXAMPLES 3 TO 4

Raw materials were weighed so that the compositions became the same as that of the example 5, and the resultants were high-frequency-melted in an Ar gas atmosphere, whereby alloy ingots were fabricated. The alloy ingots were roughly ground after heat-treated under a condition of 1160° C.×eight hours, and then finely ground by a jet mill, whereby alloy powders were prepared. Peak rising temperatures Tp of the alloy powders were found in the same manner as that of the example 1. Next, the allow powders were press-formed in a magnetic field, whereby compression-molded bodies were fabricated. Sintered magnets were fabricated by performing sintering, solution heat treatment, and aging treatment in the same manners as those of the example 5 except that the atmosphere change temperature T in the sintering step was set to temperatures shown in Table 2. An average thickness, a volume fraction, and a composition of a Cu-rich phase in each of the sintered magnets (sintered compacts), and density, a coercive force, residual magnetization, and deflective strength of each of the sintered magnets were measured in the same manners as those of the example 1. Measurement results thereof are shown in Table 3 and Table 4.

TABLE 1

| | Magnet Composition (at %) |
|---|---|
| Example 1 | $(Sm_{0.91}Nd_{0.09})_{10.99}Fe_{25.19}Zr_{1.87}Cu_{5.07}Co_{56.88}$ |
| Example 2 | $Sm_{12.05}Fe_{27.27}(Zr_{0.85}Ti_{0.15})_{1.76}Cu_{7.21}Co_{51.71}$ |
| Example 3 | $Sm_{10.81}Fe_{29.34}Zr_{1.61}Cu_{5.26}(Co_{0.998}Cr_{0.002})_{52.98}$ |
| Example 4 | $Sm_{11.30}Fe_{31.49}Zr_{1.60}Cu_{5.23}Co_{50.38}$ |
| Example 5 | $Sm_{11.05}Fe_{25.97}(Zr_{0.98}Ti_{0.02})_{1.91}Cu_{5.16}Co_{55.91}$ |
| Example 6 | $Sm_{11.05}Fe_{25.97}(Zr_{0.98}Ti_{0.02})_{1.91}Cu_{5.16}Co_{55.91}$ |
| Example 7 | $Sm_{11.05}Fe_{25.97}(Zr_{0.98}Ti_{0.02})_{1.91}Cu_{5.16}Co_{55.91}$ |
| Comparative Example 1 | $(Sm_{0.91}Nd_{0.09})_{10.99}Fe_{23.14}Zr_{1.87}Cu_{5.07}Co_{58.93}$ |
| Comparative Example 2 | $Sm_{9.80}Fe_{27.96}(Zr_{0.85}Ti_{0.15})_{1.80}Cu_{7.40}Co_{53.04}$ |
| Comparative Example 3 | $Sm_{11.05}Fe_{25.97}(Zr_{0.98}Ti_{0.02})_{1.91}Cu_{5.16}Co_{55.91}$ |
| Comparative Example 4 | $Sm_{11.05}Fe_{25.97}(Zr_{0.98}Ti_{0.02})_{1.91}Cu_{5.16}Co_{55.91}$ |

TABLE 2

| | Sintering Condition | |
|---|---|---|
| | Peak Rising Temperature Tp [° C.] | Atmosphere Change Temperature T [° C.] |
| Example 1 | 1185 | 1170 |
| Example 2 | 1160 | 1170 |
| Example 3 | 1170 | 1160 |
| Example 4 | 1160 | 1160 |
| Example 5 | 1165 | 1160 |
| Example 6 | 1165 | 1145 |
| Example 7 | 1165 | 1185 |
| Comparative Example 1 | 1185 | 1190 |
| Comparative Example 2 | 1185 | 1175 |
| Comparative Example 3 | 1165 | 1135 |
| Comparative Example 4 | 1165 | 1210 |

TABLE 3

| | Cu-Rich Phase | | |
|---|---|---|---|
| | Composition (at %) | Average thickness [μm] | Volume Fraction [%] |
| Example 1 | $(Sm_{0.91})Nd_{0.09})_{14.23}Fe_{21.15}Zr_{1.67}Cu_{8.22}Co_{54.73}$ | 0.10 | 0.03 |
| Example 2 | $Sm_{14.53}Fe_{23.42}(Zr_{0.85}Ti_{0.15})_{1.61}Cu_{15.55}Co_{44.89}$ | 0.42 | 2.01 |
| Example 3 | $Sm_{13.99}Fe_{24.76}Zr_{1.55}Cu_{9.26}(Co_{0.998}Cr_{0.002})_{50.44}$ | 0.28 | 0.07 |
| Example 4 | $Sm_{14.88}Fe_{29.78}Zr_{1.58}Cu_{8.88}Co_{44.88}$ | 0.14 | 1.05 |
| Example 5 | $Sm_{14.79}Fe_{22.42}(Zr_{0.98}Ti_{0.02})_{1.84}Cu_{9.12}Co_{51.83}$ | 0.14 | 0.34 |
| Example 6 | $Sm_{13.61}Fe_{21.56}(Zr_{0.98}Ti_{0.02})_{1.89}Cu_{7.99}Co_{54.95}$ | 0.07 | 0.08 |
| Example 7 | $Sm_{15.21}Fe_{20.89}(Zr_{0.98}Ti_{0.02})_{1.78}Cu_{13.11}Co_{49.01}$ | 1.52 | 3.25 |
| Comparative Example 1 | $(Sm_{0.91}Nd_{0.09})_{14.32}Fe_{19.78}Zr_{1.71}Cu_{8.55}Co_{55.64}$ | 0.98 | 0.05 |
| Comparative Example 2 | $Sm_{11.13}Fe_{23.43}(Zr_{0.85}Ti_{0.15})_{1.73}Cu_{13.44}Co_{50.27}$ | 0.35 | 1.86 |
| Comparative Example 3 | — | 0.002 | <0.01 |
| Comparative Example 4 | $Sm_{15.21}Fe_{21.44}(Zr_{0.98}Ti_{0.02})_{1.76}Cu_{12.45}Co_{49.14}$ | 2.24 | 5.23 |

TABLE 4

| | Density of Sintered Compact [g/cm³] | Coercive Force [ka/m] | Residual Magnetization [T] | Deflective Strength [MPa] |
|---|---|---|---|---|
| Example 1 | 8.30 | 1590 | 1.15 | 105 |
| Example 2 | 8.25 | 1420 | 1.18 | 124 |
| Example 3 | 8.27 | 1190 | 1.22 | 115 |
| Example 4 | 8.27 | 1210 | 1.25 | 110 |
| Example 5 | 8.26 | 1540 | 1.16 | 103 |
| Example 6 | 8.08 | 1740 | 1.17 | 94 |
| Example 7 | 8.32 | 1090 | 1.15 | 133 |
| Comparative Example 1 | 8.29 | 1750 | 1.09 | 101 |
| Comparative Example 2 | 8.25 | 530 | 1.18 | 113 |
| Comparative Example 3 | 8.25 | 1760 | 1.17 | 52 |
| Comparative Example 4 | 8.32 | 165 | 1.12 | 151 |

The sintered magnets of the examples 1 to 7 each have an appropriate amount (volume fraction) of the Cu-rich phase with an appropriate thickness. Consequently, they each have a good mechanical property (deflective strength) in addition to high magnetization and a high coercive force. In the sintered magnets of the examples 1 to 7, it has been confirmed from SEM-reflective electron images that the Cu-rich phases thinly exist in a streak shape in crystal grain boundaries of the sintered compact. According to the examples 1 to 7, it is possible to provide a sintered magnet excellent in magnetic property and mechanical property and having high practicability.

While certain embodiments have been described, these embodiments have been presented by way of example only, and are not intended to limit the scope of the inventions. Indeed, the novel methods described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

What is claimed is:

1. A permanent magnet, comprising a sintered compact consisting of a composition expressed by a composition formula 1:

$$R_{p1}Fe_{q1}M_{r1}Cu_{s1}Co_{100-p1-q1-r1-s1},$$

wherein R is at least one element selected from the group consisting of rare-earth elements, M is at least one element selected from the group consisting of zirconium (Zr), titanium (Ti), and hafnium (Hf), p1 is a number satisfying $10 \leq p1 \leq 13.3$ at %, q1 is a number satisfying $25 \leq q1 \leq 40$ at %, r1 is a number satisfying $0.87 \leq r1 \leq 5.4$ at %, and s1 is a number satisfying $3.5 \leq s1 \leq 13.5$ at %, wherein the sintered compact comprises crystal grains and a Cu-rich phase;

wherein each of the crystal grains is composed of a main phase including a cell phase having a $Th_2Zn_{17}$ crystal phase and a cell wall phase existing so as to surround the cell phase;

wherein the Cu-rich phase has a composition expressed by a composition formula 2:

$$R_{p2}Fe_{q2}M_{r2}Cu_{s2}Co_{100-p2-q2-r2-s2},$$

wherein R is at least one element selected from the group consisting of rare-earth elements, M is at least one element selected from the group consisting of Zr, Ti, and Hf, p2 is a number satisfying $10.8 \leq p2 \leq 11.6$ at %, q2 is a number satisfying $25 \leq q2 \leq 40$ at %, r2 is a number satisfying $1 \leq r2 \leq 2$ at %, and s2 is a number satisfying $5 \leq s2 \leq 16$ at % and $1.5 \leq s2/s1 \leq 4$; and wherein an average thickness of the Cu-rich phase is 0.1 μm or more and 2 μm or less, and the Cu-rich phase exists in grain boundaries of the crystal grains.

2. The permanent magnet according to claim 1, wherein the crystal grains have an average grain size of from 35 μm to 200 μm.

3. The permanent magnet according to claim 1, wherein a volume fraction of the Cu-rich phase in the sintered compact is 0.01% or more and 5% or less.

4. The permanent magnet according to claim 1, wherein 50 at % or more of the element R in the composition formula 1 is Sm, and 50 at % or more of the element M in the composition formula 1 is Zr.

5. The permanent magnet according to claim 1, wherein 20 at % or less of the cobalt (Co) in the composition formula 1 is substituted by at least one element A selected from nickel (Ni), vanadium (V), chromium (Cr), manganese (Mn), aluminum (Al), gallium (Ga), niobium (Nb), tantalum (Ta), and tungsten (W).

6. The permanent magnet according to claim 1, wherein a coercive force of the permanent magnet is 1090 kA/m or more and 1740 kA/m or less, and a deflective strength of the permanent magnet is 94 MPa or more and 133 MPa or less.

7. The permanent magnet according to claim 6, wherein a residual magnetization of the permanent magnet is 1.15 T or more and 1.25 T or less.

8. The permanent magnet according to claim 1, wherein the q1 in the composition formula 1 is a number satisfying $27 \leq q1 \leq 40$ at %, and the q2 in the composition formula 2 is a number satisfying $27 \leq q2 \leq 40$ at %.

9. The permanent magnet according to claim 1, wherein the sintered compact has a density of 8.08 g/cm³ or more and 8.32 g/cm³ or less.

10. The permanent magnet according to claim 1, wherein the average thickness of the Cu-rich phase is 0.15 μm or more and 2 μm or less.

11. The permanent magnet according to claim 1, wherein the volume fraction of the Cu-rich phase in the sintered compact is 0.05% or more and 5% or less.

12. A motor comprising the permanent magnet according to claim 1.

13. A power generator comprising the permanent magnet according to claim 1.

* * * * *